United States Patent [19]

Rawlings

[11] 4,020,921

[45] May 3, 1977

[54] ROOFER'S STAGING

[76] Inventor: Eugene Rawlings, 1044 Lincoln Ave., Prospect Park, Pa. 19076

[22] Filed: Nov. 28, 1975

[21] Appl. No.: 636,061

[52] U.S. Cl. ..... 182/45; 182/223

[51] Int. Cl.[2] ..... E04G 3/12

[58] Field of Search ..... 182/223, 222, 45, 119

[56] References Cited

UNITED STATES PATENTS

| | | | |
|---|---|---|---|
| 812,301 | 2/1906 | Schwedt | 182/223 |
| 1,222,053 | 4/1917 | Watson | 182/45 |
| 1,886,921 | 11/1932 | Tobin | 182/45 |

*Primary Examiner*—Reinaldo P. Machado

*Attorney, Agent, or Firm*—Frederick J. Olsson

[57] ABSTRACT

Light weight metal staging including a pair of roofer's platforms each about 4 feet in length with integral support means. On the ground, the platforms are telescoped together to make a short length, unitary pack for purposes of carrying up a ladder and depositing on a roof. On the roof, the platforms are manipulated so as to be set up in-line where one is the extension of the other to form the staging. The support means mount the staging on the roof. The overall length of the staging is about double the pack and provides a working length equivalent to that of the conventional 10 foot wood plank.

21 Claims, 13 Drawing Figures

ROOFER'S STAGING

This invention relates to roofer's equipment and in particular relates to novel staging for supporting roofers and roofing material.

The primary object of the invention is to supplant the conventional wooden plank/jack staging (which has been in use for about one hundred years without significant improvement) with staging that eliminates the problems of the plank/jack system and in addition provides novel and highly desirable advantages.

Among the disadvantages of the plank/jack system are: (*a*) the 2 inches × 8 inches × 10 feet standard roofer's plank is costly and must be continuously replaced; (*b*) the standard planks are difficult to balance in carrying up a ladder and are relatively heavy; (*c*) the standard plank can not be adjusted for small spans created by dormers, chimneys, etc., except by sawing into sections; (*d*) planks are prone to split when thrown off a roof as is conventionally done after a job is completed; (*e*) the planks and jacks are not fixedly connected and if a jack pulls loose the planks slide off the roof and moreover planks shift when walked upon, both of the foregoing conditions constituting a safety hazard; (*f*) planks tend to bend and tear a newly laid roof; (*g*) the planks and jacks all being separate and disconnected create storage problems, repetitive handling on the job and maximize trips up and down the ladders.

As the description proceeds it will be readily apparent that all of the innumerated disadvantages are eliminated by the invention.

Among the novel and desirable advantages achieved by the invention are (*a*) achieves far longer life with little or no maintenance (*b*) requires less space for storage and for transportation; (*c*) provides a light weight, unitary pack for the roofer to take up the ladder; (*e*) reduces inventory of equipment necessary to provide the lineal footage carried by a roofing contractor.

In one board aspect the invention contemplates a staging wherein there are two roofer's support platforms which, when on the ground, can be telescoped together to provide a pack of short overall length for purposes of a roofer carrying the same up a ladder and depositing on a roof and which, when on the roof, can be manipulated so as to be setup in-line whereby one is the extension of the other to form staging with an overall length of about double the pack and a working length equivalent to that of the conventional 10 foot wooden plank.

In another aspect, the invention contemplates staging of the kind mentioned which comprises a pair of platforms telescoped together so as to be relatively, longitudinally moveable as between a closed position to form a short pack and an open position where one is an extension of the other and forms the longer staging.

In another aspect, the invention contemplates a staging of a kind mentioned which comprises a pair of platforms telescoped together as by placing one on the other to form a short pack and which are separated on the roof and placed in-line so that one is an extension of the other to thereby form the longer staging.

In a further aspect the invention contemplates making a long staging run down a roof by piggy-backing that is by fixedly mounting an extended staging on the roof, carrying up a pack of additional staging, connecting the additional staging in-line with the first and similarly adding additional staging depending on the length of the run.

The invention will be described below in connection with the following drawings.

Figures 10, 10A, 10B, 11:
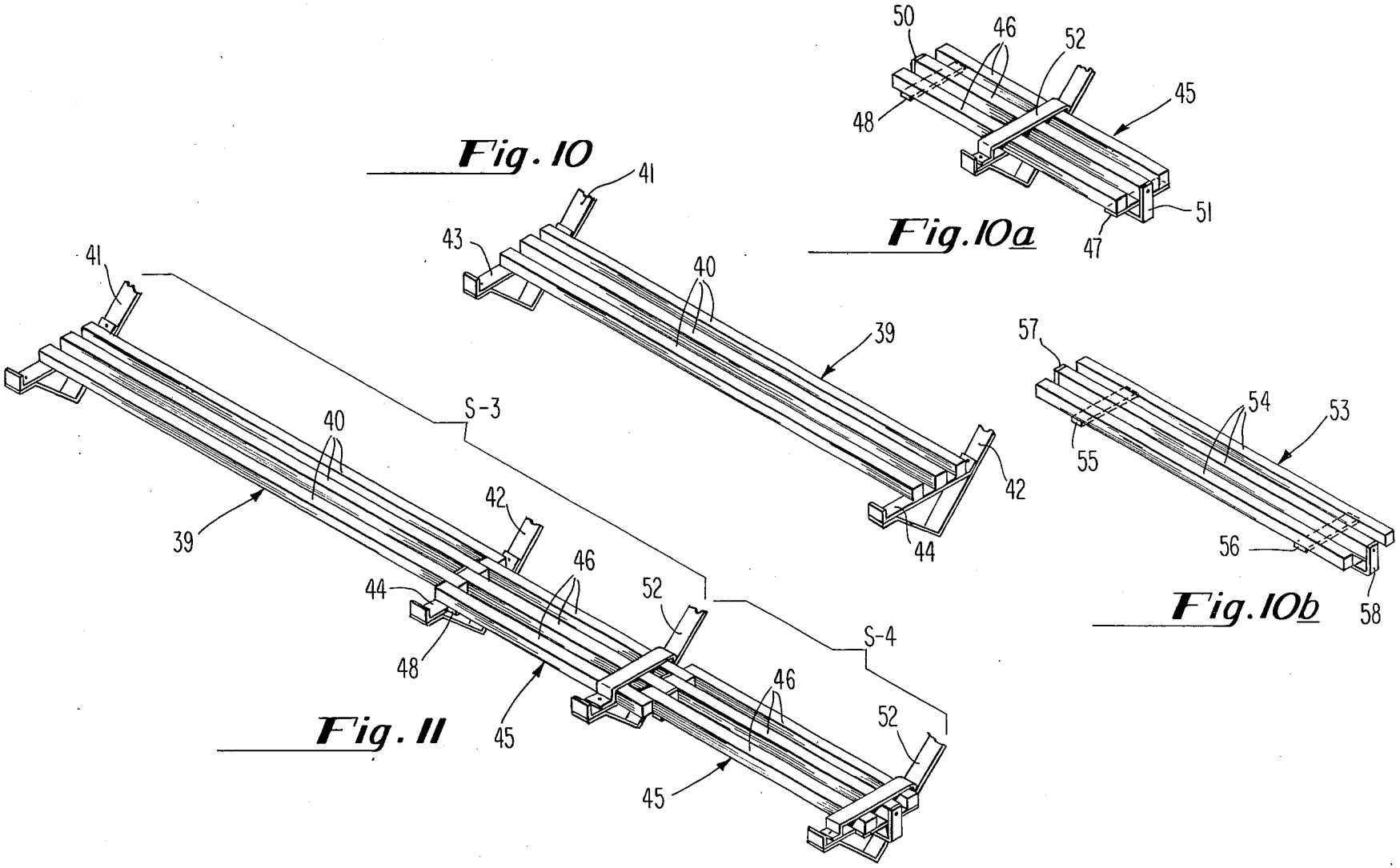

FIGS. 10, 10*a* and 10*b* are perspective views of platforms of non-permanently connected staging; and FIG. 11 is a perspective view of the platforms of FIGS. 10 and 10*a* in the in-line condition and also illustrating a piggy-back arrangement.

In presenting the invention, I will first make a broad, general overview of the structure and function of the various components and the manner in which they are related and after doing so will describe the structural details.

Figure 2:
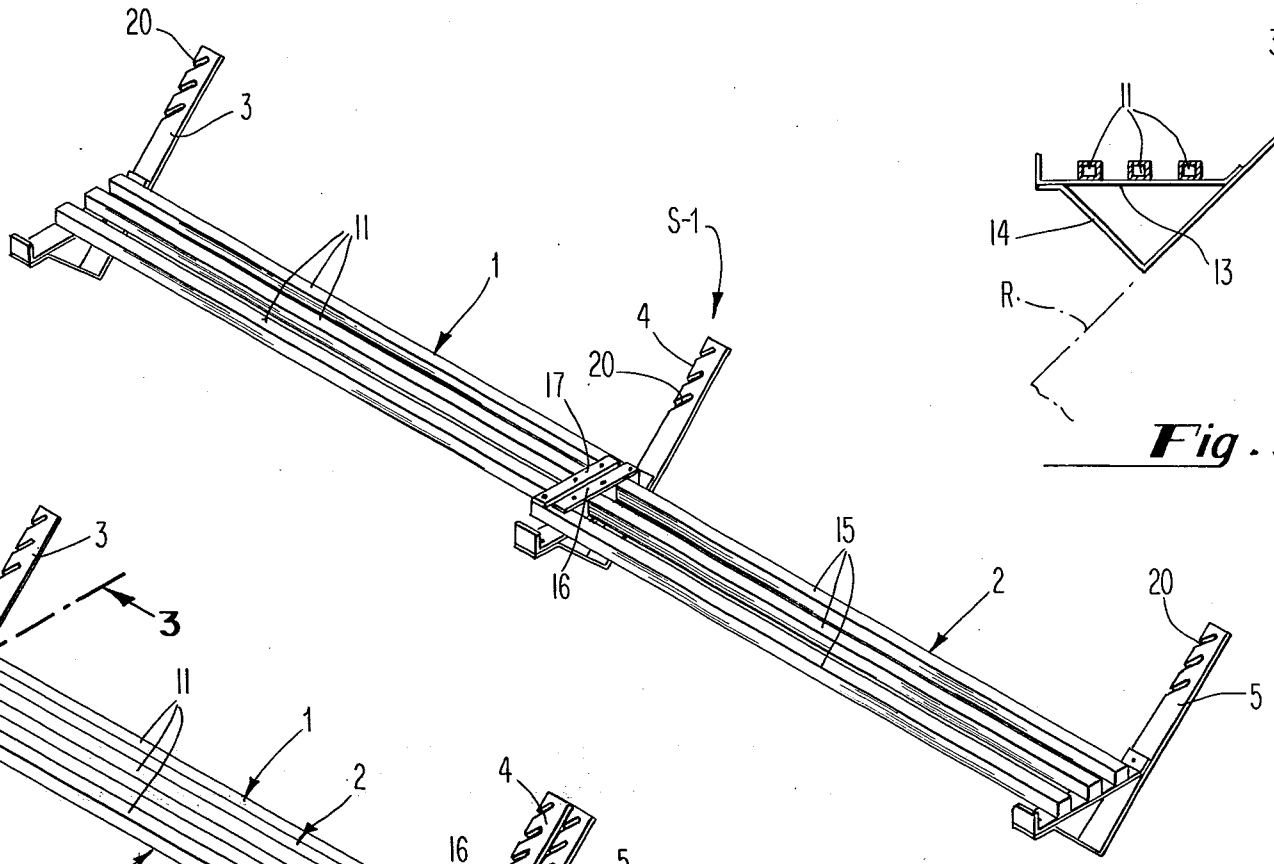
FIG. 2 is a perspective view of the staging of FIG. 1 with the platforms extended in the in-line condition as on a roof.
Figure 1:
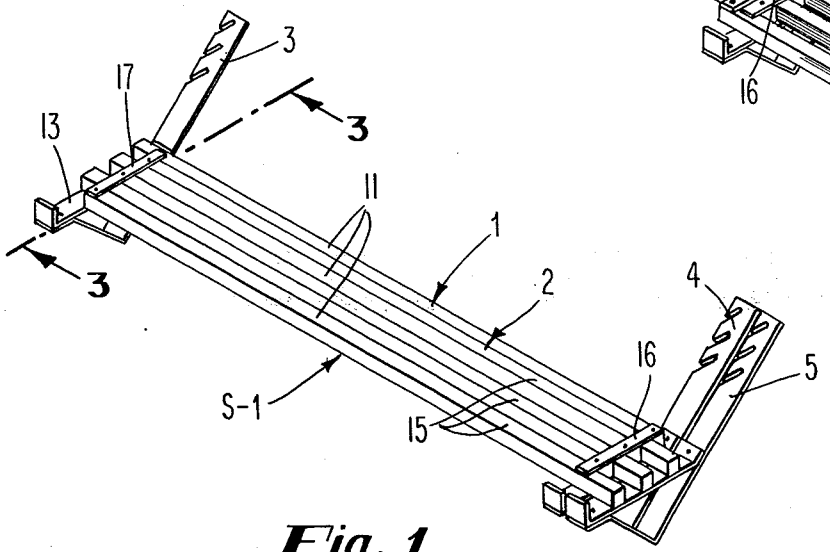
FIG. 1 is a perspective view of one embodiment of staging of the invention with the platforms in the pack condition for storage or carrying up a ladder, the platforms being permanently connected.

Referring to FIGS. 1 and 2 I have illustrated roofer's staging S-1. The stagine S-1 has platforms 1 and 2 which are telescoped together. The platforms can be moved longitudinally relative to each other as between a closed position as shown in FIG. 1 to a fully opened position as shown in FIG. 2. In the closed position of FIG. 1, the platforms 1 and 2 form a unitary pack for storage, transportation and for carrying up a ladder. In the open position of FIG. 2 the platforms are in-line with one being the extension of the other and forming the staging as used on the roof. The roofer can walk or kneel or store material on the platforms. The platforms 1 and 2 are supported on the roof by the supports 3, 4 and 5.

Preferably, each platform is 4 feet long so that in the closed position the pack is about 4 feet in length and so that in the open position the staging will have an overall length of approximately 8 feet. This provides lineal working footage equivalent to that of the conventional 2 inches × 8 inches × 10 feet wooden plank.

The weight of a conventional plank and three jacks is about 25 pounds. The weight of the staging S-1 as fabricated from light gage steel (or aluminum) is about one-half or less of the plank/jacks. When fabricated from galvanized steel or aluminum, the staging is weather resistant and the metal provides strength against impack damage so that the staging is relatively maintenance free.

For storage or transportation the pack of FIG. 1 can be nicely stacked or nested and easily handled for such purposes. The total floor space taken up in storage of staging for a given lineal working footage on a roof is about one-half of that which would be required for planks and jacks of equivalent lineal working footage.

For mounting on the roof, the roofer simply picks up the pack of FIG. 1, carries the same up to the ladder, mounts on the roof by nailing down the supports 3 and 4, shifts the ladder or moves over on the ladder stage and then extends the platform 2 (as in FIG. 2) and nails the support 5 to the roof.

Figure 5:
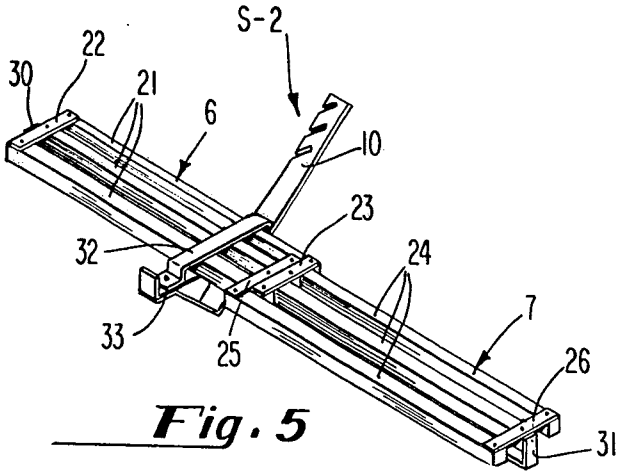
FIG. 5 is a perspective view of the staging of FIG. 4 with the platforms extended in the in-line condition as on a roof.
Figure 6:
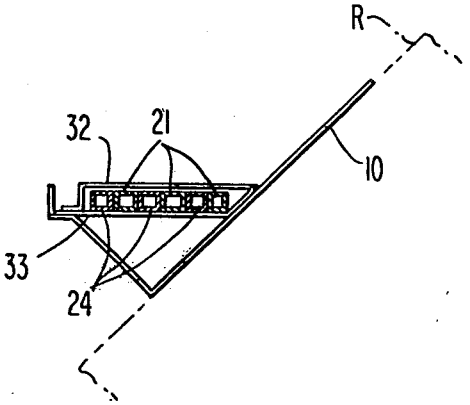
FIG. 6 is a view taken along the lines 6—6 of FIG. 4.

Normally, a roof will be much longer than 8 feet so more than one staging is employed. For such purposes the invention contemplates piggy-backing, that is to say, one or more additional extended stagings are connected to an extended stage. In this connection an additional stage may comprise one which is shorter in length. Such a stage can not only be employed for piggy-backing but in addition can be used in short spaces created by chimneys, dormer walls and the like. A typical staging of the kind in question is shown in FIGS. 4 and 5.

Figure 4:
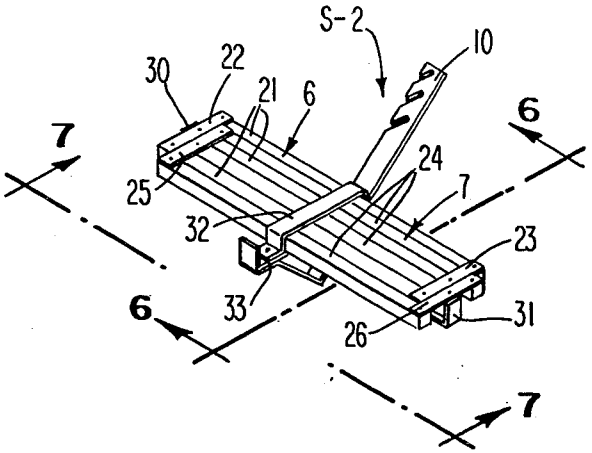
FIG. 4 is a perspective view of another embodiment of staging of the invention with the platforms in the pack position for storage or carrying up a ladder, the platforms being permanently connected.

The staging S-2 has platforms 6 and 7 which are telescoped together to form a pack as shown in FIG. 4. The platforms can be moved longitudinally as between the closed position of FIG. 4 to the fully open position of FIG. 5 wherein the platforms are arranged in-line with one being an extension of the other to form the staging for the roof. A support 10 is mounted so as to be shiftable along the platforms and is used for supporting the staging on the roof. The tops of the platforms provide the roofers work and material storage area.

In the closed position as shown in FIG. 4, the overall longitudinal length of the pack is approximately 2 feet and in the fully extended position approximately 4 feet. The length in the closed position is especially useful in those narrow areas created by dormer walls, chimneys, etc.

It will be understood that the staging lengths mentioned are preferred and that longer or shorter lengths may be employed.

Figures 8, 9:
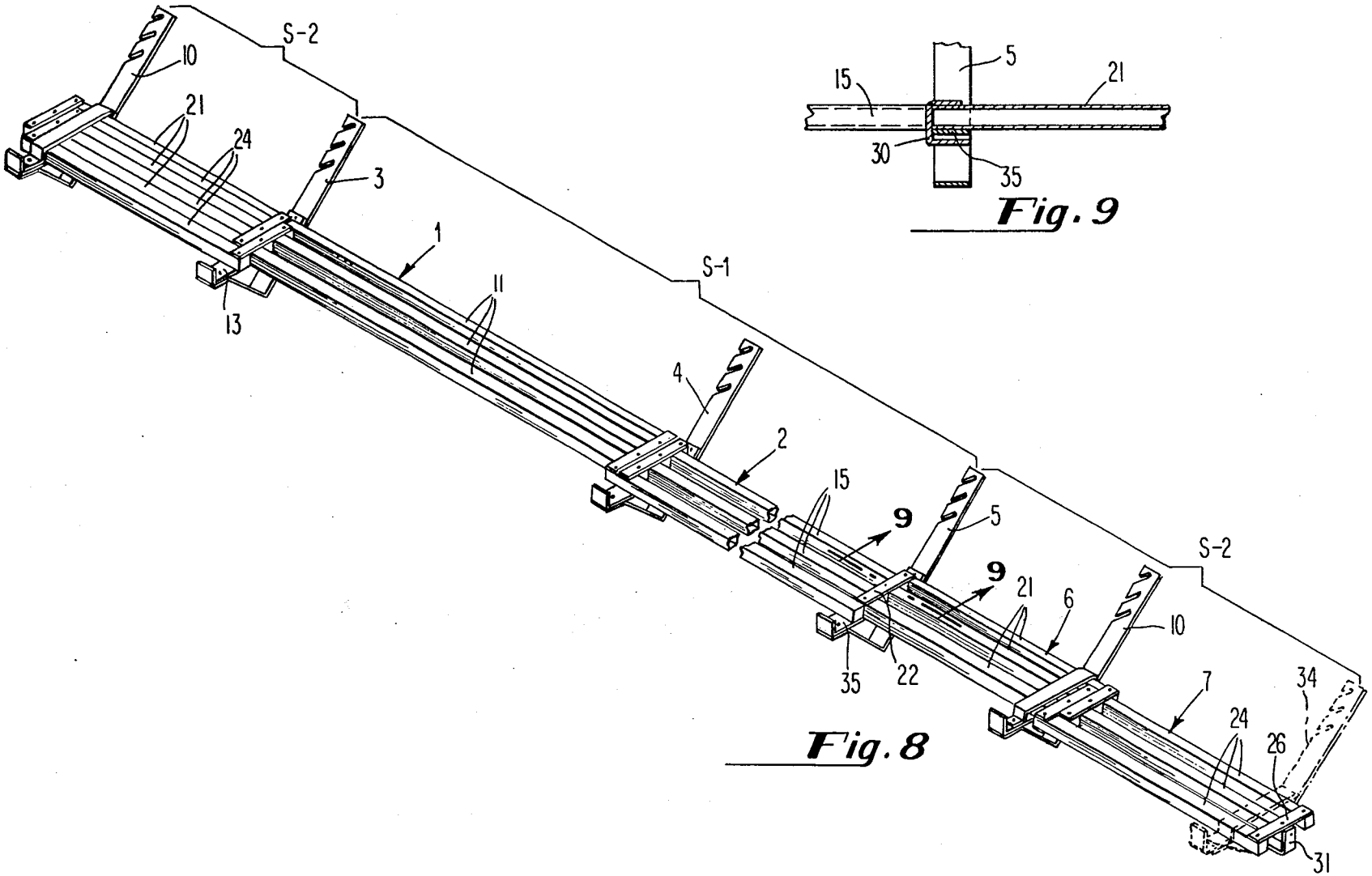
FIG. 8 is a perspective view of a piggy-back arrangement of the stagings of FIGS. 1 and 2 and FIGS. 4 and 5.
FIG. 9 is a view taken along the lines 9—9 of FIG. 8.

A piggy-back arrangement of the stagings S-1 and S-2 is illustrated in FIG. 8. This might be used to span a run of approximately 14 feet. Thus, on the right hand side of FIG. 8 the extended staging S-2 is connected to the extended staging S-1. On the left side, another staging S-2 arranged in the closed position is connected to the staging S-1. For long runs the invention contemplates that stagings S-1 and S-2 be alternately coupled together along the run. How this is accomplished will appear later.

In the stagings S'and S-2 the platforms are permanently connected together. In FIGS. 10–11 I have illustrated an arrangement where the platforms are not permanently connected but which are adapted to be arranged in a pack on the ground and put in extended arrangement on the roof and also adapted to be piggy-backed. The manner in which it is accomplished will appear later.

Having broadly considered the various stagings of the invention, I will now describe the structural details starting with the staging S-1.

Figure 3:
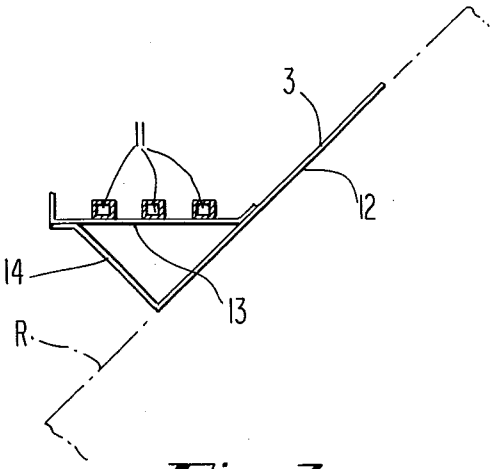
FIG. 3 is an elevational view taken along the lines 3—3 of FIG. 1.

Referring to FIGS. 1, 2 and 3 the platform 1 includes a plurality of beams 11 which are spaced apart and extend parallel to and co-extensive with one another. The tops of the beams are co-planar.

The support 3 is disposed adjacent the left hand end of the beams 11. As noted in FIG. 3, the support has a roof section 12 and a platform section 13. The roof section 12 includes the brace 14 which is welded to one end of the platform section. The other end of the platform section is welded to the roof section. The roof section 12 is adapted to engage a roof R to mount the staging thereon as indicatedin FIG. 3. The platform section 13 engages and supports the beams 11. Weldments preferably connect the beams to the platform section so that the beams are fixedly interconnected together. With reference to the left hand end of platform 1, it will be observed that the platform section 13 and the spaces between beams 11 provide several open areas. These areas are for use in connecting another roofer's staging or platform.

The support 4 has the same construction as support 3 and serves the same purpose. The ends of the beams 11 are welded to the platform section of the support 4.

The platform 2 includes the beams 15 which are spaced apart and extend parallel and co-extensive with each other. The tops of the beams 15 are co-planar with each other and with the tops of the beams 11.

On right hand end the beams 15 are connected to the platform section of the support 5 which is identical to the construction of support 3. The beams are welded to the platform section so as to be fixedly interconnected. The platform section of the support 5 and the space between the beams 15 provide open areas for use in connecting another roofer's platform or staging.

With reference to closed condition of FIG. 1, the beams 11 are disposed in the spaces between the beams 15 and the beams 15 in turn are disposed in the spaces between the beams 11. The various spaces between the beams are dementioned to provide clearance for the beams to be relatively moved longitudinally. In the closed position of FIG. 1 the beams 11 occupy substantially all of the spaces between the beams 15 and the beams 15 occupy substantially all of the spaces between the beams 11. In the open position of FIG. 2, the beams 11 and beams 15 are substantially free from each other except in the area adjacent the support 4. It will be seen therefore that the beams 11 and 15 are telescoped together in that one group of beams is removeably disposed within the other group of beams so that the beams can be nested for pack form and separated for stage forming.

The means to permanently join the beams or prevent disengagement and to determine the closed and open positions are noted following:

Referring to the right hand end of the platform 1, a strip 16 extends across beams 11 and is welded thereto. The strip 16 also extends across the tops of the beams 15 and is slightly spaced from the tops to provide clearance. The strip 16 prevents the beams 15 from being lifted out of the telescoped position. On the left hand end of the platform 2, a strip 17 (located between the supports 3 and 4) extends across the beams 15 and is welded thereto so that the beams are fixedly interconnected. The strip also extends across the beams 11 and slides along the tops of beams 11 when the platforms are moved. The strip maintains the telescoping condition and particularly the co-planar arrangement in the closed position.

In the fully open position the strips 16 and 17 engage and this determines the fully open position. In the closed position the support 5 engages the support 4 and this determines the closed position.

In each of the supports 3, 4 and 5 I have shown the slots 20, which are used for nailing the supports to a roof.

The structural details of staging S-2 of FIGS. 4 and 5 will next be described.

The platform 6 includes the beams 21 which are spaced apart and extend parallel to and co-extensive with one another. The tops of the beams are co-planar. The straps 22 and 23 at the opposite ends of the beams 21 are welded to the same and fixedly connect the beams.

The platform 7 includes the beams 24 which also are spaced apart and extend parallel to and co-extensive with each other. The tops are co-planar with the tops of beams 21. The straps 25 and 26 at the opposite ends of beams 24 are welded to same and fixedly interconnect the beams.

The beams 21 are disposed in the spaces between the beams 24 and the beams 24 are in turn disposed in the spaces between beams 21. In the closed position of FIG. 4 substantially all of the spaces are occupied and in the open position the beams are free except at the ends as noted in FIG. 5. Thus the beams 21 and 24 have the same telescoped condition as the beams of FIGS. 1 and 2.

Figure 7:
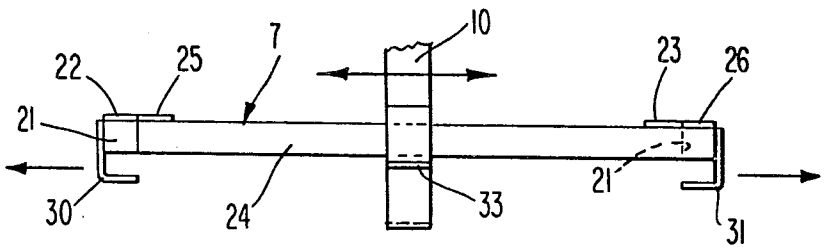
FIG. 7 is a view taken along the lines 7—7 of FIG. 4.

For connecting the staging S-2 to another staging the platforms 6 and 7 are provided with hooks. On the left hand end, the platform 6 has a hook 30 connected to one of the beams 21. On the right hand end, the platform 7 has a hook 31 connected to one of the beams 21. As best seen in FIG. 7, each hook extends downwardly and underneath the beam to which it is connected.

The engagement of the straps 22–25 and 23–26 determines the closed position and the engagement of straps 23 and 25 determines the open position. The beams 21 are trapped by strap 25 and beams 24 are trapped by strap 23 for permanently connecting the beams and for maintaining the telescoped condition.

The support 10 is structured so that it can be shifted along the platforms and also assist in maintaining the telescoped condition when the beams are in the closed position. In the support 10 a keeper 32 extends above the platform section 33 and is in spaced relation to the beams 21 and 24. The opposite ends of the keeper are welded to the platform section 33. The keeper and platform section form a socket with sufficient clearance to permit movement of the beams as between the open and closed positions and for the support to be shifted. The socket assists in maintaining the telescope condition in the closed position as will be noted in FIG. 4. The support is prevented from becoming disegaged with the beams by the hooks 30 and 31.

With reference to FIG. 4 it will be seen that in the closed position both the beams 21 and 24 rest on the platform section 33 and with reference to FIG. 5 it will be seen that only the beams 21 rest on the platform in a fully open position.

In the extended or open position the outboard end of either the beams 6 or 7 is connected to a staging and the opposite end must be supported. This is illustrated in FIG. 8 where the platform 34 supports the right hand end of staging S-2.

There are several advantages attained by the shifting support. One advantage is that the S-2 staging can be connected to the left side or to right side simply by shifting the support. For example, in FIG. 8 the support 10 is shifted right for connecting the staging S'to the right side of S-1 and the support 10 is shifted left for connecting the staging S-2 to the left side of S-1. Another advantage is that when the S-2 staging is connected, the support on the end of the other staging also supports the connected end of the S-2 staging. This eliminates the need for an additional support. A further advantage is that adjacent the end of a roof when the remaining distance is less than 2 feet, the support can be shifted to the roof edge and automatically shorten the working length of staging.

The manner in which the stagings of FIG. 8 are piggy-backed will next be described.

In the telescoped arrangement one set of beams is laterally off-set one space from the other set. This is taken into account in connecting one stage to another as indicated below.

First an S-1 staging in pack form is carried up the ladder, placed on the roof, and the supports 3 and 4 are nailed in position. Normally the ladder is set up so that when the stage S-1 is set on the roof it extends equally on opposite sides of the ladder. This makes the supports 3 and 4 easily accessible. Then the ladder is moved to the right about 4 feet or the roofer moves over if a ladder stage is employed. The platform section 2 is then fully extended and the support 5 nailed down in position on the roof.

The ladder is again shifted about 4 feet and then S-2 staging in pack form is carried to the roof. The S-2 staging is slightly extended and the support 10 positioned on the right side. The beams 21 of the platform 6 are placed above the spaces between beams 15 and laterally off-set one space. With the hook 30 positioned clear of the platform section 35, the beams 21 are lowered into the spaces between the beams 15 and shifted to the right until the hook 30 engages the platform section 35 and extends under the same as shown in FIG. 9. The support 10 is then nailed to the roof.

The platform 7 is moved to the fully open position and a support such as the support 34 is placed under the beams 24 and nailed to the roof.

The position of support 34 under the beams 24 will depend on conditions. If another staging is to be connected, the support 34 will abut the hook 31 or be located at some intermediate position if the staging is at the edge of the roof.

The staging S-2 on the left hand side of FIG. 8 is similarly set up.

For a very long run, the preferred piggy-back arrangement contemplates alternate S'and S'stagings. The joining of an S-1 stage to an S-2 is explained following. Assume that stagings S-1 and S-2 are piggy-backed as shown in FIG. 8 and another S-1 stage is to be connected to the S-2 stage at the right side of FIG. 8. A support such as the support 34 is placed under the beams 24 simply to hold the beams upwardly. Then the left hand end of an S-1 staging (slightly extended and shifted laterally one space) is moved up under the right hand end of the staging S-2 so that the beams 11 are below the spaces between the beams 24 and so that the hook 31 is clear of the platform section. Then the beams 11 are moved up into the spaces and shifted to the right until the platform section is engaged with the hook. At this point the strap 26 will engage the tops of the beams 11. Then the supports 3 and 4 of the staging S-1 are nailed to the roof and the platform section 2 is fully extended and the support 5 nailed in position. The next S-2 staging is connected to the S-1 staging in a manner as explained above.

The invention also contemplates a piggy-back arrangement by having an S-1 staging coupled with several S-2 stagings. For this purpose the structure of the staging S-2 shown in FIGS. 4 and 5 is slightly modified by that the outbaord straps 22 and 26 are spaced inwardly on the beams instead of being flush as shown. The mount by which a strap is spaced inward is slightly greater than the width of a platform section of a support so that in the coupling operation the underside extension of the hook will pass thru the space between the strap and the platform section. The manner in which several S-2 stagings are piggy-backed on an S-1 staging will be explained in connection with staging S-2 at the right hand side of FIG. 8.

For present purposes, assume that the support 34 is butted against the hook 31. An S-2 pack is carried to the roof and is slightly extended and the support 10 moved all the way to the right. The beams 21 are then positioned above the spaces between beams 24 and laterally off-set one space. The beams 21 are then lowered into the spaces with the hook 30 moving down between the strap 26 and the platform section of support 34 until the beams 21 rest on the platform section. The staging is then moved to the right until the hook 30 abutts the plaform section. The support 10 is then nailed to the roof. The platfrom section 7 is then fully extended and a support placed under the right-hand end and nailed to the roof. Another S-2 staging is then connected similarly explained above.

In FIGS. 10–11 the stagings shown are not permanently joined as are the stagings heretofore described. However, the stagings 10–11 can be packed on the ground and extended on the roof as will be described following.

In FIG. 10, the platform 39 includes a plurality of beams 40 which are spaced apart and extend parallel to and co-extensive with one another. The tops of the beams are co-planar and constitute a working surface for a roofer. The support 41 is located adjacent one end of the beams and is identical to the supports heretofore described. The beams 40 are welded to the platform section 43 of the support whereby the beams are fixedly interconnected. A support 42 at the opposite end is identical in constriction with the support 41. The platform section 44 of the support is welded to the beams whereby the beams are fixedly interconnected.

It will be observed the spaces between the beams 40 at each end and the platform sections 43 and 44 provide a plurality of open areas. These areas are for use in connecting another roofer's platform.

In FIG. 10*a*, the platform 45 includes the beams 46 which extend parallel and co-extensive with one another with the tops of the beams being co-planar. The respective ends of the beams are fixedly interconnected by the straps 47 and 48. Hooks 50 and 51 which are similar to the hooks heretofore described are connected to the opposite ends of one of the beams. A shiftable support 52 which is similar to the support 10 is mounted on the beams and can be shifted back and forth.

In FIG. 10*b*, the platform 53 includes the beams 54 which extend parallel and co-extensive with one another with the tops of the beams being co-planar. The straps 55 and 56 extend across the bottom of the beams and are welded thereto so that the beams are fixedly interconnected. The hooks 57 and 58 are connected to one of the beams 54. The hooks are the same as the hooks heretofore described.

For arranging the platform 39 of FIG. 10 and the platform 45 of FIG. 10*a* into pack form for storage and for taking up a ladder, the support 52 is moved to say the right-hand end against hook 51. Then the platform is turned upside down and the beams 46 are placed in the spaces between the beams 40 with the support 52 adjacent the support 42. The platforms are thus telescoped together to make a short unitary pack. For carrying up the ladder, the pack is held by one arm and oriented in a generally vertical direction with the support 52 bearing on the support 42. On the roof the platform 45 is separated from the platform 39 and hooked on to the plaform 39 in a manner heretofore described. Thus the platforms 39 and 45 are in line and one is the extension of the other whereby to form the staging. This is indicated in FIG. 11 where the platforms 39 and 45 as hooked together are designated as staging S-3.

The platform 39 and the platform 53 are similarly packed on the ground and separated on the roof with one end of the beams 54 connected to one end of the platform 39. The opposite end of the beams 53 is provided with an additional support.

A typical piggy-back arrangement is illustrated in FIG. 11, the staging S-3 is shown connected to a staging S-4 which is the same as the stage 45 in FIG. 10*a*.

With reference to FIG. 10*a*, it will be noted that the strap 48 is spaced inwardly from the beam edges and that the strap 47 is flush. With this construction the platforms 45 can be connected to the platform 39 only in a direction to the right hand side of the platform 39. By positioning the strap 47 inwardly, the platform 39 can be connected to both the right and left sides.

Before closing, it is to be noted that the beams making up the platforms are preferably rectangular shaped tubes as shown in FIG. 3. The ends of the beams in the other views are shown as solid for the sake of clarity, It will be understood that the beams may be in the form of solid bars or channels.

I claim:

1. A roofer's staging comprising:

a first platform including a plurality of first beams spaced apart and extending parallel to and co-extensive with one another, the tops of the beams being co-planar and constituting a platform for a roofer;

a first support adjacent one end of said first beams and having a roof section and a platform section, the roof section being adapted to engage a roof for mounting the staging thereon and the platform section engaging and supporting said first beams;

a second support adjacent the opposite end of said first beams and having a roof section and a platform section, the roof section being adapted to engage a roof for mounting the staging thereon and the platform section engaging and supporting said first beams;

means respectively at said one end and at said opposite end of said first beams fixedly interconnecting the beams and the respective platform sections;

a second platform including a plurality of second beams spaced apart and extending parallel to and co-extensive with one another, the tops thereof being substantially co-planar with first said tops and constituting a second platform for a roofer and said first beams and said second beams being telescoped together at least in the area above the platform section of said second support and the first and second platform being in-line whereby one is the extension of the other;

a third support adjacent one end of the second beams and having a roof section and a platform section, the roof section being adapted to engage a roof for mounting the staging thereon and the platform section engaging and supporting said second beams; and means at said one end of said second beams fixedly interconnecting the beams with the platform section of said third support.

2. The roofer's staging of claim 1 further including means at the opposite end of said second beams fixedly interconnecting the second beams.

3. The roofer's staging of claim 1 further including means at the opposite end of said second beams fixedly interconnecting the beams and there is at least one opening adjacent said third support and between a pair of second beams for connecting another roofer's staging.

4. A roofer's staging comprising:

a platform including a plurality of beams spaced apart and extending parallel to and co-extensive with one another, the tops of the beams being co-planar and constituting a platform for a roofer;

a first support adjacent one end of said beams and having a roof section and a platform section, the roof section being adapted to engage a roof for mounting the staging thereon and the platform section being fixedly connected to and supporting the beams, the platform section and the spaced beams at said one end providing a plurality of open areas for connecting another roofer's staging; and a second support adjacent the opposite end of said beams and having a roof section and a platform section, the roof section being adapted to engage a roof for mounting the staging thereon and the platform section being fixedly connected to and supporting said beams at said opposite end, the platform section and the spaced beams at said opposite end providing a plurality of open areas for connecting another roofer's staging.

5. A roofer's staging comprising:

a first platform including a plurality of first beams spaced apart and extending parallel to and co-extensive with one another, the tops being co-planar and constituting a platform for a roofer;

a first support adjacent one end of said first beams and having a roof section and a platform section, the roof section being adapted to engage a roof for mounting the staging thereon and the platform section being fixedly connected to and supporting the first beams, the platform section and the spaced beams at said one end providing a plurality of open areas for connecting another roofer's staging;

a second support adjacent the opposite end of said first beams and having a roof section and a platform section, the roof section being adapted to engage a roof for mounting the staging thereon and the platform section being fixedly connected to and supporting the first beams;

a second platform including a plurality of second beams spaced apart and extending parallel to and co-extensive with one another,the tops being co-planar with first said tops and constituting a second platform for a roofer;

means connected to said second beams adjacent one of the ends thereof and fixedly interconnecting the beams;

a third support adjacent the opposite end of said second beams and having a roof section and a platform section, the roof section being adapted to engage a roof for mounting the staging thereon and the platform section being fixedly connected to and supporting said second beams at last said opposite end, the platform section and the spaced beams at last said opposite end providing a plurality of open areas for connecting another roofer's staging;

at least part of the first beams being disposed in the spaces between the second beams and at least part of the second beams being disposed in the spaces between first beams whereby to be telescoped together and the respective spaces being dimensioned to provide clearance for the first and second beams to slide longitudinally relative to one another as between a closed position and an open position, in the closed position the first beams occupying substantially all of the spaces between the second beams and the second beams occupying substantially all of the spaces between the first beams and in the open position the first beams being substantially free from the spaces between the second beams and the second beams being substantially free from the spaces between the first beams and the first and second platforms being in-line whereby one is the extension of the other when in said open position;

means connected to the first and second beams to determine said open and closed positions; and means connected to the first and second beams to prevent the first and second beams from being disengaged in the open and closed positions.

6. A roofer's staging comprising:

a first platform including a plurality of first beams spaced apart and extending parallel to and co-extensive with one another, the tops being co-planar and constituting a platform for a roofer;

a first support adjacent one end of said first beams having a roof section and a platform section, the roof section being adapted to engage a roof for mounting the staging thereon and the platform section being fixedly connected to and supporting said first beams, the platform section and the spaced beams at said one end providing a plurality of open areas for connecting another roofer's staging;

a second support adjacent the opposite end of said first beams and having a roof section and a platform section, the roof section being adapted to engage a roof for mounting the staging thereon and the platform section being fixedly connected to and supporting the first beams;

a second platform including a plurality of second beams spaced apart and extending parallel to and co-extensive with one another, the tops being co-planar with first said tops and constituting a second platform for a roofer;

at least part of the first beams being disposed in the spaces between the second beams and at least part of the second beams being disposed in the spaces between first beams whereby to be telescoped together and the respective spaces being dimensioned to provide clearance for the first and second beams to slide longitudinally relative to one another as between a closed position and an open position, in the closed position the first beams occupying substantially all of the spaces between the second beams and the second beams occupying substantially all of the spaces between the first beams and in the open position, the first beams being substantially free from the spaces between the second beams and the second beams being substantially free from the spaces between the first beams and in the open position the first and second platforms being in-line whereby one is the extension of the other;

means connected to the first and second beams to determine said open and closed positions; and means connected to the first and second beams to prevent the first and second beams from being disengaged in the open and closed positions.

7. A roofer's staging comprising:

a first platform including a plurality of first beams spaced apart and extending parallel to and co-extensive with one another, the tops being co-planar and constituting a platform for a roofer;

a first support adjacent one end of said first beams and having a roof section and a platform section, the roof section being adapted to engage a roof for mounting the staging thereon and the platform section being fixedly connected to and supporting said first beams, the platform section and the spaced beams at said one end providing a plurality of open areas for connecting another roofer's staging;

a second support adjacent the opposite end of said first beams and having a roof section and a platform section, the roof section being adapted to engage a roof for mounting the staging thereon and the platform section being fixedly connected to and supporting the first beams;

a second platform including a plurality of second beams spaced apart and extending parallel to and co-extensive with one another, the tops being co-planar with first said tops and constituting a second platform for a roofer;

at least part of the first beams being disposed in the spaces between the second beams and at least part of the second beams being disposed in the spaces between first beams whereby to be telescoped together and the respective spaces being dimensioned to provide clearance for the first and second beams to slide longitudinally relative to one another as between a closed position and an open position, in the closed position the first beams occupying substantially all of the spaces between the second beams and the second beams occupying substantially all of the spaces between the first beams and in the open position, the first beams being substantially free from the spaces between the second beams and the second beams being substantially free from the spaces between the first beams and the first and second platforms being in-line whereby one is the extension of the other when in said open position;

a first strap adjacent the platform section of the second support and extending across at least some of the first beams and fixedly connected thereto, the first strap also extending across at least some of the second beams to maintain the second beams in the space between the first beams;

a second strap disposed between the first and second supports and adjacent one end of the second beams and extending across at least some of the second beams and fixedly connected thereto, the second strap also extending across some of the first beams and the second strap engaging the first strap to determine said open position and preventing the first and second beams from being disengaged; and a third support adjacent the opposite end of said second beams and having a roof section and a platform section, the roof section being adapted to engage a roof for mounting the staging thereon and the platform section being fixedly connected to and supporting said second beams at said opposite end and the third support engaging said second support to determine said closed position, the platform section of said third support and the spaces second beams providing a plurality of open areas for connecting another roofer's stage.

8. A roofer's staging comprising:

a first platform including a plurality of first beams spaced apart and extending parallel to and co-extensive with one another, the tops being co-planar and constituting a platform for a roofer;

a second platform including a plurality of second beams spaced apart and extending parallel to and co-extensive with one another, the tops being co-planar with first said tops and constituting a second platform for a roofer;

at least part of the first beams being disposed in the spaces between the second beams and at least part of the second beams being disposed in the spaces between first beams whereby to be telescoped together and the respective spaces being dimensioned to provide clearance for the first and second beams to slide longitudinally relative to one another as between a closed position and an open position, in the closed position the first beams occupying substantially all of the spaces between the second beams and the second beams occupying substantially all of the spaces between the first beams and in the open position, the first beams being substantially free from the spaces between the first beams and the first and second platforms being in-line whereby one is the extension of the other when in said open position.

first and second straps respectively disposed adjacent the opposite ends of said first beams and extending across the the first beams and means connecting the first and second straps to the first beams whereby the beams are fixedly connected together and the second strap also extending across at least some of the second beams;

means disposed adjacent said first strap and connected adjacent to the end of one of the beams to which the strap is connected and having mechanism engagable with another roofer's platform for joining the platforms together;

third and fourth straps respectively disposed adjacent opposite ends of said second beams and extending across the second beams and means connecting the third and fourth straps to the second beams whereby the second beams are fixedly connected together and the third strap also extending across at least some of the first beams;

in said open and closed positions at least one strap on the first beams engaging at least one strap on the second beams to respectively determine the open and closed positions; and a support having a roof section and a platform section the roof section being adapted to engage a roof for mounting the staging thereon and the platform section being adapted to engage said first and second beams when the same are in the closed position and to engage said first beams when the first and second beams are in the open position;

9. A roofer's staging comprising:

a first platform including a plurality of first beams spaced apart and extending parallel to and co-extensive with one another, the tops being co-planar and constituting a platform for a roofer;

a second platform including a plurality of second beams spaced apart and extending parallel to and co-extensive with one another, the tops being co-planar with first said tops and constituting a second platform for a roofer;

at least part of the first beams being disposed in the spaces between the second beams and at least part of the second beams being disposed in the spaces between first beams whereby to be telescoped together and the respective spaces being dimensioned to provide clearance for the first and second beams to slide longitudinally relative to one another as between a closed position and an open position, in the closed position the first beams occupying substantially all of the spaces between the second beams and the second beams occupying substantially all of the spaces between the first beams and in the open position, the first beams being substantially free from the spaces between the second beams and the second beams being substantially free from the spaces between the first beams and the first and second beams being in-line whereby one is the extension of the other; when in said open position;

first and second straps respectively disposed adjacent the opposite ends of said first beams and extending across the beams and means connecting the first and second straps to the beams whereby the beams are fixedly connected together and the second strap also extending across at least some of the second beams;

third and fourth straps respectively disposed adjacent opposite ends of said second beams and extending across the second beams and means connecting the third and fourth straps to the second beams whereby the second beams are fixedly connected together and the third strap also extending across at least some of the first beams;

in said open and closed positions at least one strap on the first beams engaging at least one strap on the second beams to respectively determine the open and closed positions;

a support having a roof section and a platform section the roof section being adapted to engage a roof for mounting the staging thereon and the platform section being adapted to engage said first and second beams when the same are in the closed position and to engage said first beams when the first and second beams are in the open position, a keeper extending above said platform section in spaced relation to the tops of said first and second beams, the opposite ends of the keeper being fixed to the platform section and the keeper and platform section constituting a socket providing for the support to be shifted back and forth along the first beams;

a first hook disposed adjacent said first strap and connected adjacent to the end of one of the first beams; and a second hook disposed adjacent said fourth strap and connected adjacent to the end of one of the second beams and each said hook having a portion extending downwardly from and underneath the beam to which the hook is connected, each hook being for use in connecting the respective beams to beams of another roofer's platform.

10. A roofer's staging comprising:

a plurality of beams spaced apart and extending parallel to and co-extensive with one another, the tops being co-planar and constituting a platform for a roofer;

a first strap extending across the beams adjacent one end thereof and means fixedly connecting the strap to the beams whereby the beams are fixedly interconnected together;

a first hook disposed adjacent said first strap and fixedly connected adjacent to the end of one of the beams, the hook extending downwardly from and underneath the beam to which it is connected and the hook being for use in joining the platform to another roofer's platform;

a second strap extending across the beams adjacent the opposite end thereof and means fixedly connecting the strap to the beams whereby the beams are fixedly interconnected together;

a second hook disposed adjacent said second strap and connected adjacent to the end of one of the beams, the hook extending downwardly from and underneath the beam to which it is connected and the hook being for use in joining the platform to another roofer's platform; and a support mounted on said beams for supporting the same on a roof.

11. The staging of claim 10 wherein said first strap is spaced inwardly from said one end and said second strap is flush with the opposite end.

12. The staging of claim 10 where said first strap is spaced inwardly from said one end and said second strap is spaced inwardly from said opposite end.

13. The staging of claim 10 wherein said support has a roof section and a platform section, the roof section being adapted to engage a roof for mounting the platform thereon and the platform section engaging and supporting said beams, a keeper extending above said platform section in spaced relation to the tops of the beams, the opposite ends of the keeper being fixed to the platform section and the keeper and platform section constituting a socket providing for the support to be shiftable back and forth along the beams.

14. A roofer's staging comprising:

a plurality of beams spaced apart and extending parallel to and co-extensive with one another, the tops being co-planar and constituting a platform for a roofer, the spaced beams at each end respectively providing a plurality of open areas for connecting another roofer's platform;

a first strap extending across the beams adjacent one end thereof and means fixedly connecting the strap to the beams whereby the beams are fixedly interconnected together;

a first hook disposed adjacent said first strap and fixedly connected adjacent to the end of one of the beams, the hook extending downwardly from and underneath the beam to which it is connected and the hook being for use in joining the bridge to another roofer's platform;

a second strap extending across the beams adjacent the opposite end thereof and means fixedly connecting the strap to the beams whereby the beams are fixedly interconnected together; and a second hook disposed adjacent said second strap and connected adjacent to the end of one of the beams, the hook extending downwardly from and underneath the beams to which it is connected and the hook being for use in joining the platform to another roofer's platform.

15. A roofer's staging comprising:

a first and second platforms to be set up in-line on a roof wherein one is an extension of the other whereby to form the staging;

the first platform including a plurality of first beams spaced apart and extending parallel to and co-extensive with one another, the tops of the beams being co-planar and constituting a platform for a roofer;

the second platform including a plurality of second beams spaced apart and extending parallel and co-extensive with one another, the tops thereof being co-planar and constituting a second platform for a roofer;

support mechanisms respectively extending across the first and second beams and fixedly interconnecting the first beams together and fixedly interconnecting the second beams together and the support mechanisms having means for mounting the staging on a roof; and the spacing between the first beams and the spacing between the second beams providing for a substantial portion of the first beams to be removably disposed in the spaces between the second beams and a substantial portion of the second beams to be removeably disposed in the spaces between the first beams to thereby form a unitary pack for a roofer to carry up a ladder for depositing on a roof, the overall length of the pack being substantially less than the length of the staging in said in-line condition and said removeability of said beams from said spaces providing for the platforms, when on the roof, to be manipulated by the roofer for positioning the same in said in-line condition.

16. A roofer's staging comprising:

first and second platforms to be set up in line on a roof wherein one is an extension of the other whereby to form the staging;

the first platform including a plurality of first beams spaced apart and extending parallel to and co-extensive with one another, the tops of the beams being co-planar and constituting a platform for a roofer;

the second platform including a plurality of second beams spaced apart and extendinng parallel and co-extensive with one another, the tops thereof being co-planar and constituting a second platform for a roofer;

the spacing between the first beams and the spacing between the second beams providing for a substantial portion of the first beams to be removeably disposed in the spaces between the second beams and substantial portion of the second beams to be removeably disposed in the spaces between the first beams to thereby form a unitary pack for a roofer to carry up a ladder for depositing on a roof, the overall length of the pack being substantially less than the length of the staging in said in-line condition and said removeability of said beams from said spaces providing for the platforms, when on the roof, to be manipulated by the roofer for positioning the same in said in-line condition;

means connected with said first beams and means connected with said second beams to maintain respectively the beams in said spaces when the beams are formed into said pack and when the beams are in said in-line condition; and a support having a roof section and a platform section the roof section being adapted to engage a roof for mounting the staging thereon and the platform section being adapted to engage said first and second beams when the same are formed in said pack and to engage said first beams when the first and second beams are in said in-line condition, a keeper extending above said platform section in spaced relation to the tops of said first and second beams, the opposite ends of the keeper being fixed to the platform section and the keeper and platfrom section constituting a socket providing for the support to be shifted back and forth along the first beams.

17. A roofer's staging comprising:

a first platform including a plurality of first beams spaced apart and extending parallel to and co-extensive with one another;

a first support adjacent one end of said first beams and having a roof section and a platform section, the roof section being adapted to engage a roof for mounting the staging thereon and a platform section being fixedly connected to and supporting said first beams;

a second support adjacent the opposite end of said first beams and having a roof section and a platform section, the roof section being adapted to engage a roof for mounting the staging thereon and the platform section being fixedly connected to and supporting said first beams;

a second platform including a plurality of second beams spaced apart and extending parallel and co-extensive with one another;

a third support adjacent one end of the second beams and having a roof section and a platform section, the roof section being adapted to engage a roof for mounting the staging thereon and the platform section being fixedly connected to and supporting said second beams;

said first and second beams telescoped together whereby the respective beams and their supports are longitudinally slidable relative to one another as between a closed position and an open position, in the closed position, the respective beams forming a unitary pack for a roof to carry up a ladder and deposit on a roof, the length of the pack being substantially less than the length of the staging in the open position and in the open position the beams being longitudinally spaced whereby one platform is an extension of the other and an expanded staging is formed;

means connected to the first and second beams to determine said open and closed positions; and means connected to the first and second beams to prevent the first and second beams from being disengaged in the open and closed positions so that the beams are telescoped together both in the open and closed positions.

18. A roofer's staging comprising:

a platform including a plurality of beams spaced apart and extending parallel to and co-extensive with one another, the tops of the beams being co-planar and constituting a platform for a roofer;

a first support adjacent one end of said beams and having a roof section and a platform section, the roof section being adapted to engage a roof for mounting the staging thereon and the platform section being fixedly connected to and supporting the beams;

at least one opening between a pair of adjacent beams and disposed adjacent said first support for connecting another roofer's staging thereto; and a second support adjacent the opposite end of said beams and having a roof section and a platform section, the roof section being adapted to engage a roof for mounting the staging thereon and the platform section being fixedly connected to and supporting said beams at said opposite end.

19. A roofer's staging comprising:

a first platform including a plurality of first beams spaced apart and extending parallel to and co-extensive with one another, the tops of the beams being co-planar and constituting a platform for a roofer;

a first support adjacent one end of said first beams and the support having a roof section and a platform section, the roof section being adapted to engage a roof for mounting the staging thereon and the platform section being fixedly connected to and supporting said first beams at said one end;

a second support adjacent the opposite end of said first beams and having a roof section and a platform section, the roof section being adapted to engage a roof for mounting the staging thereon and the platform section being fixedly connected to and supporting said first beams at said opposite end;

a second platform including a plurality of second beams spaced apart and extending parallel to and co-extensive with one another, the tops thereof being substantially co-planar with first said tops and constituting a second platform for a roofer;

a first strap extending across the second beams adjacent one end thereof and means fixedly connecting the strap thereto whereby the beams are fixedly interconnected together;

a second strap extending across the second beams adjacent the opposite end thereof and means fixedly connecting the strap thereto whereby the beams are fixedly interconnected together;

said first and second beams being telescoped together at least in the area above the platform section of said second support and said second beams at said one end thereof being supported by the platform section of said second support and the first and second platforms being in-line whereby one is the extension of the other;

a hook disposed adjacent said first strap and fixedly connected adjacent to the end of one of the second beams, the hook connecting the second platform with the first platform;

a third support adjacent the opposite end of the second beams and having a roof section and a platform section, the roof section being adapted to engage a roof for mounting the staging thereon and the platform section engaging and supporting said second beams at said opposite end thereof.

20. The platform of claim 19 further including a keeper extending above the platform section of said third support in spaced relation to the tops of said second beams, the opposite ends of the keeper being fixed to the platform section of said third support and the keeper and platform section constituting a socket providing for the support to be shifted back and forth along the second beams.

21. A roofer's staging comprising:

a first platform including a plurality of first beams spaced apart and extending parallel to and co-extensive with one another, the tops of the beams being co-planar and constituting a platform for a roofer;

a first support adjacent one end of said first beams and the support having a roof section and a platform section, the roof section being adapted to engage a roof for mounting the staging thereon and the platform section being fixedly connected to and supporting said first beams at said one end;

a second support adjacent the opposite end of said first beams and having a roof section and a platform section, the roof section being adapted to engage a roof for mounting the staging thereon and the platform section being fixedly connected to and supporting said first beams at said opposite end;

a second platform including a plurality of second beams spaced apart and extending parallel to and co-extensive with one another, the tops thereof being substantially co-planar with first said tops and constituting a second platform for a roofer;

means fixedly interconnecting the second beams together, said first and second beams being telescoped together at least in the area above the platform section of said second support and said second beams being engaged with and supported by the platform section of said second support and the first and second platforms being in line whereby one is the extension of the other;

a hook fixedly connected adjacent to the end of one of the second beams, the hook connecting the second platform with the first platform; and a third support adjacent the opposite end of the second beams and having a roof section and a platform section, the roof section being adapted to engage a roof for mounting the staging thereon and the platform section being fixedly connected to and supporting said second beams at said opposite end thereof.

* * * * *